US005714989A

United States Patent [19]

Wade

[11] Patent Number: 5,714,989

[45] Date of Patent: Feb. 3, 1998

[54] INKDROP-VOLUME TEST USING HEAT-FLOW EFFECTS, FOR THERMAL-INKJET PRINTERS

[75] Inventor: John M. Wade, Poway, Calif.

[73] Assignee: Hewlett-Packard Company, Palo Alto, Calif.

[21] Appl. No.: 156,172

[22] Filed: Nov. 22, 1993

[51] Int. Cl.[6] ..... B41J 2/195

[52] U.S. Cl. ..... 347/14; 347/7

[58] Field of Search ..... 347/19, 18, 60, 347/14, 7

[56] References Cited

U.S. PATENT DOCUMENTS 4,982,199 1/1991 Dunn ..... 347/60
5,206,668 4/1993 Lo et al. ..... 347/19

*Primary Examiner*—Benjamin R. Fuller
*Assistant Examiner*—Craig A. Hallacher

[57] ABSTRACT

The invention provides methods of determining ink volume ejected from a printhead, controlling ejected volume, and warning of low ink supply. A printhead is fired to eject ink: this operating step includes heating the ink and head; carrying away heat, in the ejected volume, from the head; and conveying a volume of cooler ink to the head, from a supply, to replace the ejected ink. The method finds the head cooling caused by the carrying-away and conveying; and to this applies a known calibration to find the volume ejected. The heating is roughly equal to that which occurs in printing. Besides the operating step, the method preferably includes finding (a) printhead cooling due to static mechanical thermal drain alone, and (b) printhead thermal response to warming by the same amount of heat as used to fire the pen in the operating step—but without ink ejection. These baseline values are used with the cooling observed in the operating step to isolate the effect of ink ejection and so find the cooling more accurately. The warming can be done by applying electrical energy to printhead-firing resistors, at pulse widths narrower than used for firing—but greater frequency—to inject power equal to that in normal operation. The temperature measurements are made by monitoring a conventional sensing resistor in the pen, and can include fitting a linear slope to the observed temperature-vs.-time relation.

20 Claims, 8 Drawing Sheets

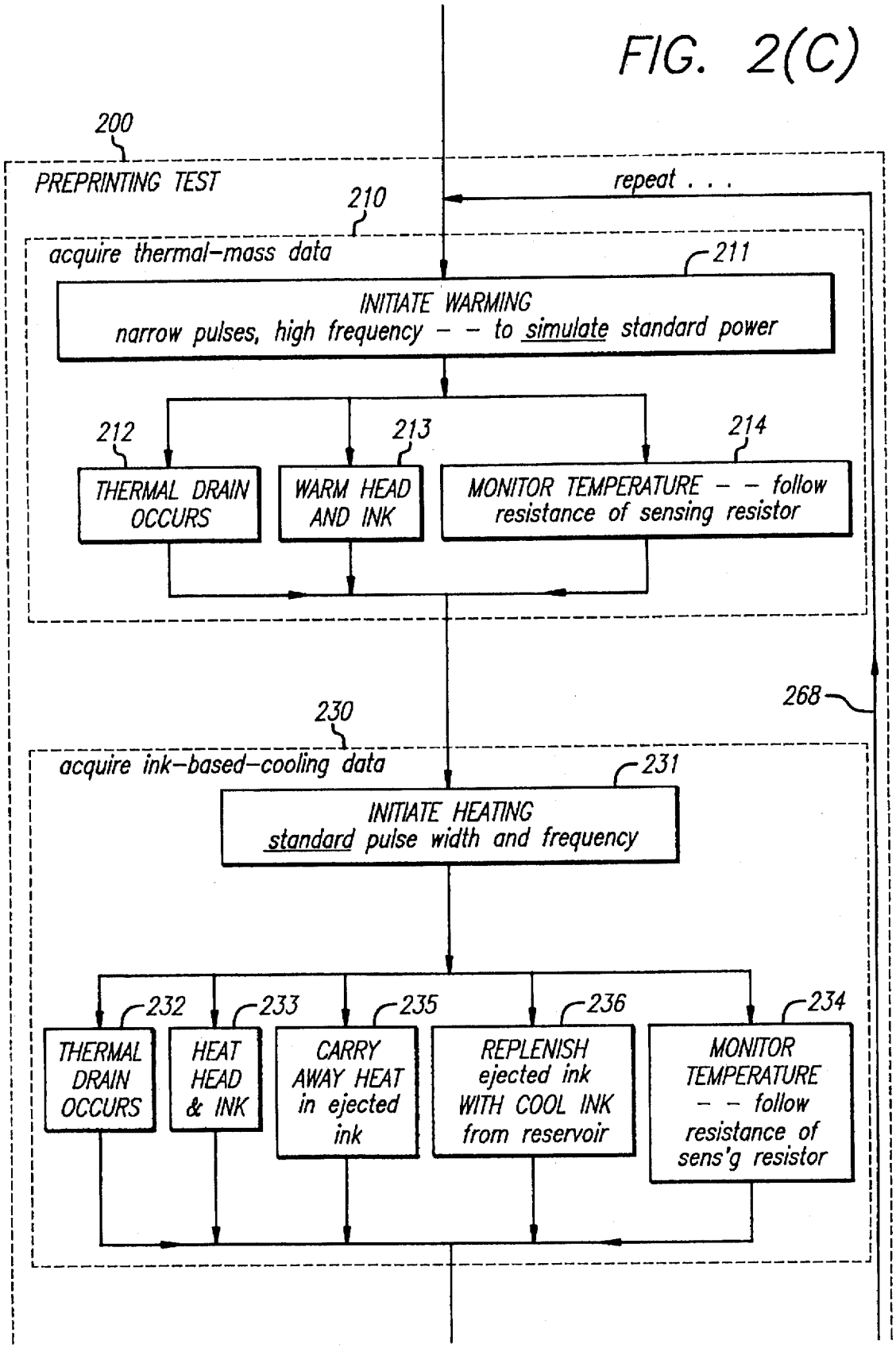
FIG. 2(C)
200
PREPRINTING TEST
repeat . . .
210
acquire thermal-mass data
211
INITIATE WARMING
narrow pulses, high frequency – – to simulate standard power
212
THERMAL DRAIN OCCURS
213
WARM HEAD AND INK
214
MONITOR TEMPERATURE – – follow resistance of sensing resistor
268
230
acquire ink-based-cooling data
231
INITIATE HEATING
standard pulse width and frequency
232
THERMAL DRAIN OCCURS
233
HEAT HEAD & INK
235
CARRY AWAY HEAT in ejected ink
236
REPLENISH ejected ink WITH COOL INK from reservoir
234
MONITOR TEMPERATURE – – follow resistance of sens'g resistor

INKDROP-VOLUME TEST USING HEAT-FLOW EFFECTS, FOR THERMAL-INKJET PRINTERS

RELATED PATENT DOCUMENTS

A related copending United States utility-patent application commonly owned by the assignee of the present document and incorporated by reference in its entirety into this document is being filed in the United States Patent and Trademark Office on or about Oct. 29, 1993, in the name of John M. Wade et al., and identified as Hewlett Packard Company docket number PD-1092602-1, and entitled "THERMAL TURN-ON ENERGY TEST FOR AN INKJET PRINTER"—and subsequently assigned utility-patent application Ser. No. 08/145,904, and issued as U.S. Pat. No. 5,428,376 on Jun. 27, 1995.

BACKGROUND

1. Field of the Invention

This invention relates generally to machines and procedures for printing text or graphics on printing media such as paper, transparency stock, or other glossy media; and more particularly to a thermal-inkjet machine and method that construct text or images from individual ink spots ejected onto a printing medium from nozzles in one or more thermal-inkjet pens.

2. Related Art

An important factor in thermal-inkjet printing is the volume of ink applied to a printing medium by firing the pen printhead—or printheads, in the case of a pen with plural ink chambers.

Each printhead comprises a large number (typically twelve to more than a hundred) of individual modules, each capable of being fired to eject an individual drop or "jet" of ink. Each of these modules includes:

- an individual heating element or resistor (part of a generally planar integrated circuit),
- an individual nozzle or orifice (formed in a generally planar orifice plate), and
- an individual ink-containing cell (part of a maze-like structure of ink passageways formed in a generally planar spacer, called the "barrier", which is disposed between the integrated circuit and the orifice plate).

For purposes of this document, each of these modules consisting of one resistor, one nozzle and one cell will be called a "jet module".

To fire a jet module once, a pulse of electrical energy is directed into the heating element or resistor which forms part of that module, to abruptly raise the temperature of the resistor. The hot resistor vaporizes a small amount of ink in the cell, immediately adjacent to the heating element.

Abrupt expansion of this vapor expels from the cell, through the orifice, a still-liquid drop of ink from a position just inside the orifice.

If the applied energy is excessive, or insufficient to perform this process reliably, the result can be a variety of problems which I shall group into two categories:

(1) overheating, underheating, and their consequences, which I shall call "energy-management problems"; and (2) overinking, underinking, and their consequences, which I shall call "ink-volume problems".

Energy-management problems are taken up in the related patent document mentioned above. For purposes of this document I shall simply assume that the energy applied to each jet module is appropriate to resolve all such problems.

The present document addresses ink-volume problems. The volume of ink ejected from an inkjet-pen printhead, for a particular or representative image, is the aggregate of volumes ejected from all its jet modules in forming that image.

The volume ejected from each jet module is subject to production tolerances in resistance of the heating resistor; in positioning as between the resistor, barrier and nozzle; in dimensions of the cell and printhead orifice; and to a lesser extent in other phenomena, perhaps relatively more precise, such as pulse duration and power-supply voltage and impedance.

Such tolerances taken together imply an overall uncertainty in volume of each resulting drop, and hence in total volume of ink ejected from a pen and deposited on a printing medium. In view of this volume-uncertainty implication, instrument design requires a careful tradeoff between (1) the drawbacks of applying incorrect inking volume—due to the uncertainty arising from these tolerances—and (2) the often-significant expense of imposing tighter tolerances.

An alternative is (3) production-line measurement of drop volume from each pen or each printhead, and encoding of each pen or printhead by modifying nonvolatile firmware memory in the pen. In this way each pen can be forced to eject ink volumes within an acceptable range of magnitudes or values.

The second and third of these approaches to dealing with ink-volume uncertainty are well known and understood by people skilled in the arts of electronic and mechanical design—and particularly people familiar with those arts as related to inkjet technology. Such individuals will understand that these approaches are relatively undesirable on account of their cost; and also provide at best a limited solution to the inking problem in that they can only correct the performance of a pen when new, and are not able to follow a pen into the field and accommodate changing characteristics of the pen during its life.

On the other hand the first possibility, namely providing either too little or too much ink, because of manufacturing tolerances, is subject to several adverse consequences. These too are well known.

A major problem of underinking is unacceptable esthetic defects—particularly inadequate saturation of colors. Applying significant extra ink generally leads to:

- excessive drying times,
- ink smearing (which is worst on plastic printing media as they are relatively unabsorbent),
- puckering or cockle of printed paper because of the large amount of liquid soaking the fibers of the sheet,
- offset or ink transfer to the back of adjacent sheets, and even
- adhesion of adjacent sheets;

and also can occur in the form of oversize inkdrops that create different kind of image defects, such as for instance a mottled appearance of portions of the image. Combinations of some or all of these effects can occur.

Another consideration in thermal-inkjet printer operation is exhaustion of the ink supply in each pen reservoir. Some modern printers have drop sensors for determining photoelectrically when a pen (or individual nozzle) is not firing, so that the printer can be shut down and an alarm or indicator actuated—alerting the operator to replace the pen or reservoir when the ink has run out, and thereby avoid wasting time and paper.

Such a system is useful but generally provides only an indication that ink is already exhausted. A preferable operating mode would alert the operator that ink is about to run out; no such electronic early-warning system is now available.

Some thermal-inkjet printers include certain features which have not heretofore been associated with improvements to inking accuracy, or with warning that ink will soon run out. One such feature is a so-called "thermal-sensing resistor" incorporated into the pen; corresponding circuitry and firmware for reading the sensing resistor is incorporated into the printers themselves.

One way to use an excessive-temperature indication from the sensing resistor system is to shut down the printer or slow down printing. In some printers the sensing resistor is made part of a feedback system that holds pen temperature to a desired value.

The pen temperature can be restrained, when desired, by slowing the print rate; and if desired can be raised to a nominal operating temperature by warming of the pen when the pen is not being used to eject ink. Use of an elevated nominal operating temperature enhances temperature stabilization, and provides isolation from ambient-temperature changes.

For this purpose the system can automatically apply to the heating resistors electrical pulses that are not wide enough to fire the respective jet modules. A compensating increase in pulse frequency, above that conventionally used to fire the modules, can be employed to make the overall power application sufficient to hold the pen temperature at the desired nominal value.

It has not been suggested heretofore that the thermal-sensing resistor—or application of narrower, higher-frequency pulses to the heating resistors—might be useful in controlling of inking volume or in warning of imminent ink exhaustion.

Accordingly as can now be seen, the prevailing technology in this field has not heretofore provided any entirely economical way to (1) control inking volume—within a precisely defined range of values, to avoid problems of both underinking and overinking; or (2) provide advance warning of ink exhaustion. Thus important aspects of the technology which is used in the field of the invention are amenable to useful refinement.

SUMMARY OF THE DISCLOSURE

The present invention introduces such refinement. Before offering a relatively rigorous discussion of the present invention, some informal orientation will be provided here.

It is to be understood that these first comments are not necessarily intended as a statement of the invention. They are in the nature of insights that will be helpful in recognizing the underlying character of the related-art problems discussed above (such insights are considered to be a part of the inventive contribution associated with the present invention)—or in comprehending the underlying principles upon which the invention is based.

As already mentioned, a modern inkjet pen has a thermal-sensing resistor system—but the conventional readout from that system arises from a variety of different operating conditions; it cannot be used directly for adjustment or other real-time management of overall inking. Also heretofore no suggestion has appeared that the sensing resistor system might yield an early warning of ink exhaustion.

The thermal-sensing resistor does nevertheless provide a window into the operating world of a thermal-inkjet pen. Properly utilized, this window can make visible the parameter of particular interest in the present invention—namely, the volume of ink ejected from the pen.

Ink volume is of interest not only to avoid over inking/underinking while ample ink supply remains in a pen. I have observed that inkdrop volume begins to fall when a printhead is about to run out of ink; hence periodic volume measurement—and comparison with earlier like measurements—yields an indication of probable imminent ink exhaustion. This indication can be used to develop printer shutdown, or use of a reserve pen, or an operator warning, or combinations of these tactics as desired.

More specifically, inkdrop volumes can be ascertained on the basis of the physical relations discussed below.

When a thermal-inkjet pen operates to eject ink, heat must be applied to the jet modules—as described in an earlier section of this document. This heat elevates the temperature of the printhead, and eventually (but to a lesser extent) the temperature of the ink reservoir that supplies the jet modules.

The reservoir in turn leaks heat to the pen body and thence eventually to ambient. The printheads accordingly are cooled by this flow of heat through intermediate components to—successively—the reservoir, body and ambient.

In operation, however, another component of cooling comes into play: each expelled inkdrop leaving the printhead is hot. Not only is each drop generally near the heating resistor, but also each drop consists of ink that was previously just inward from the orifice and so was immediately adjacent to the heating resistor—and a small part of which was used to form the vapor bubble that ejected a previous drop.

Accordingly, the ink itself leaving each jet module in the printhead carries away in each drop some quantity of heat from the printhead. This ink ejected from the printhead is replaced by cooler ink that flows into the head from the reservoir—through intermediate components—when the propulsion bubbles collapse. (Each propulsion bubble itself after collapse/condensation amounts to a very small volume.) The overall result is to restrain the temperature at the printhead.

Unfortunately, however, in normal operation of each jet module all these three things happen at once:

(1) heating by the heating resistor—and in particular associated flow of some of this injected heat into or out of the thermal mass or thermal capacitance of the jet module;

(2) cooling by heat drain toward the reservoir, pen body and ambient through intermediate components as will be explained; and (3) cooling by carrying-away of heat in the inkdrops and replacement by cooler ink from the reservoir—through intermediate components.

Hence in normal operation, for example, the heat flow out with each ejected drop and replenishment from the reservoir (here element #3) cannot be isolated from the cooling by heat drain (here element #2)—which is ordinarily dominant in magnitude.

The cooling by ejected-drop heat flow and replacement—element #3—is in principle related to the desired parameter, drop volume, directly. The larger the drop, the greater the amount of heat it carries away and the greater the amount of cooling produced by its replenishment flow. Therefore isolation of this #3 effect is desirable for best accuracy in use of this heat-flow component for volume determination.

Through automatic data acquisition—using special automatic procedures provided in the firmware of each printer—it becomes possible to eliminate algebraically the effects of the other two elements #1 and #2, and so isolate the component of cooling due to ejected drops and their cooler replacement. A known calibration relationship ship can then be applied to this information, to determine the drop volume.

The drop-volume magnitude or value in turn can then be used to control the printing machine so as to avoid excessive image inking—and also to warn when the ink supply is about to run out, so as to avoid wasted paper, time and operator patience.

In principle, one way to use the information of drop-volume magnitudes to control inking is to control directly the energy applied to the jet modules to fire inkdrops—lowering the energy slightly, for example, in an effort to reduce drop size if overall ink volume is too high. That technique is within the scope of the present invention.

As a practical matter, however, it is currently believed preferable to control overall inking through so-called "depletion algorithm" techniques—in which inkdrops are selectively omitted from particular portions of the image being created.

It is currently believed that direct control of drop volume by varying temperature runs a risk of adversely complicating the energy management of the pen. For instance, changing drop volume that way may lead to undesirably high or low ink temperatures—which tend to lead in turn to ink viscosity variations. Depletion-algorithm techniques, on the other hand, avoid such risks and can accomplish the same results of controlling inking volume.

To eliminate the unknown effects of elements #1 and #2 introduced above—the heat flow to and from the thermal capacitance of each jet module, and the cooling by heat drain toward the reservoir, pen body and ambient—thermal characteristics of the jet modules and overall pen structures can be probed using these two measurement steps:

applying to the heating resistor a series of special warming pulses that do not eject ink, and using the thermal sensing resistor to monitor the thermal response (element #1 above) to this warming for a set time period; and turning off all incoming heat, and similarly using the thermal-sensing resistor to determine the rate of jet-module cooling due to passive mechanical drain alone (element #2 above) for another set time period.

As will be seen in detail shortly, I prefer to interpose between these two measurements my observation of thermal behavior during essentially normal inkdrop ejection (element #3)—also for a specified time period.

The special "warming" pulses mentioned in the preceding paragraph can be, for example, of the same amplitude as those used to eject ink from the pen—but shorter in duration. In other words, the special warming can be accomplished by narrow pulses; to simulate normal overall power into the printhead these are preferably applied to the heating resistor at correspondingly higher frequency.

Elimination of the effects of element #1—flow of the incoming heat flow to and from the jet-module thermal mass or "thermal capacitance"—is accomplished in essence by determining the magnitude of that thermal capacitance. (To be more precise, what is determined is the thermal capacitance of all the jet modules in the printhead, as the effects observed in accordance with my invention are too small to be readily measured except in the aggregate.) That capacitance value is algebraically separated from the effects of cooling by heat drain toward the reservoir (found by separate measurement as already noted above), to be later incorporated into algebraic determination of the heat flow out with the ejected ink.

The various algebraic relations are greatly simplified by assuming that the printhead temperature is approximately the same in all three phases of the analysis. To render these simplified relations reasonably accurate, data should be judiciously selected as will be shown later in this document.

Element #3—the heat flow out with ejected drops—is then found by substituting standard ink-ejecting electrical pulses for the special warming pulses, and then observing the resulting rate of cooling—and correcting for the now-known thermal capacitance (#1) and static mechanical cooling (#2). The corrected cooling rate is representative of the volume of ink being ejected by the standard ejecting pulses.

The relationships between the various parameters discussed above are complicated somewhat by the nonlinear cooling and heating patterns associated with the thermal mass of the pen body, reservoir, intermediate components, and jet modules. Analysis, however, is readily facilitated by various standard methods used in heat-flow engineering; their result is to reduce the problem to a matter of simple algebra, whose processes in turn are readily included in the firmware programmed into the printing machine.

As already suggested above, electrical engineers in particular may find helpful the common analogy of heat flow to electrical flow. In this analogy the thermal equivalent of "voltage" is actually temperature, conveniently expressed in degrees Centigrade (°C.); and thermal "current" stands for heat transfer or flow, preferably in watts (W), i.e., joules per second (J/sec)—but with a conversion to calories per second (cal/sec) when needed. In this formulation we analogize thermal mass to a so-called "capacitive" element, such thermal capacitance having units of joules per degree Centigrade (J/°C.). The heat drain through intermediate components to the reservoir and the heat conveyance by the ejected ink will follow, respectively, the common analogies to a so-called "resistive" element and a "current drain" element. The thermal "resistance" has units of degrees Centigrade per watt (°C./W).

Now with these preliminary observations in mind this discussion will proceed to a perhaps more-formal summary. In its preferred embodiments, the present invention has at least three primary or main facets or aspects, which are to a degree amenable to use independently of one another—although for highest enjoyment of the advantages of the invention they are preferably practiced in conjunction together.

In preferred embodiments of a first of these primary aspects or facets, the invention is a method of running a thermal-inkjet printing machine that has a thermal-inkjet pen and that uses ink ejected from a printhead of the pen to mark on a printing medium. The method comprises performing a volume-ascertaining sequence which includes the steps of:

operating the pen printhead to eject a volume of ink;

determining the amount of cooling of the printhead produced by the carrying-away and conveying substeps; and correlating the determined amount of cooling with ejected ink volume according to a known calibration relationship, to ascertain the magnitude of the volume of ink ejected.

The first of these three steps, the operating step, in turn comprises the substeps of (1) heating the ink and printhead, (2) carrying away heat, in the ejected volume of ink, from the printhead, and (3) conveying a volume of cooler ink to the printhead, from an ink supply, to replace the ejected volume.

In addition to performing the volume-ascertaining sequence described above, the invention in its first aspect also includes then applying the ascertained magnitude to control actuation of the pen printhead—to eject ink for marking on a printing medium.

The foregoing may be a definition or description of the first aspect of the invention in its broadest or most general form. Even in this form, however, this facet of the invention can be seen to resolve the difficulties of the related technology that have been described earlier in this document.

In particular, this method is quickly and readily performed by an automatic printing machine before printing, or between printing intervals—and using an amount of pen heating that is equal or closely related to the amount which occurs during actual printing. Once the magnitude of ejected ink volume is ascertained, any of various techniques can be used at the final "applying" stage to avoid all the consequences, described earlier, of ink-volume uncertainty or unanticipated ink exhaustion, or both.

The "applying" portion of the method can include display of the ascertained magnitude for use by an operator of the machine; that is to say, the operator may perform portions of the method. Alternatively the applying stage can be automatic.

This method in its broad form thus provides a solution to the problems described above. Nevertheless it is preferably practiced with certain other features or characteristics that optimize and enhance the benefits of the invention.

For example, it is preferable that the applying include using the ascertained magnitude to control the ink volume ejected for marking on the print medium. Although such a "using" operation can include direct control ink volume ejected, as mentioned earlier I prefer to instead use the ascertained magnitude to control a depletion algorithm—which in turn controls the ink volume ejected for marking on the print medium.

As another example it is preferable that the applying include using the ascertained magnitude to trigger a low-ink-supply operating mode—if the ascertained magnitude corresponds to imminent ink-supply exhaustion. A low-ink-supply operating mode preferably includes warning an operator of imminent ink-supply exhaustion.

Another feature of a low-ink-supply operating mode is preferable to include in a printer which—as is normally the case—provides relative motion between the printing medium and a marking axis of the pen, concurrently with the printhead actuation for marking on a printing medium. In such a printer, it is preferable that a low-ink-supply operating mode include inhibiting the relative motion and the marking.

Still another functional feature of a low-ink-supply operating mode is preferable to include in a printing machine that has at least two pens. That feature includes taking out of service a pen for which ink-supply exhaustion is imminent—and putting into service another pen.

This arrangement is particularly beneficial in printing equipment that is used on an unattended-standby basis, as for example a facsimile-transceiver ("FAX") machine. Such devices are generally operated overnight and on weekends, when no operator is available in offices to change pens.

Also preferably, reverting again to the basic method of the first aspect of the invention, the determining step includes making an allowance for thermal leakage from the printhead to a body of the pen. To facilitate the making of such an allowance, I prefer that the determining step include monitoring printhead temperature decline while no heat is applied to the printhead and no ink is ejected from the printhead.

Analogously it is preferable that the determining step include making an allowance for thermal mass of the printhead, or for heat flow into or out from that thermal mass. (As will shortly be seen from an algebraic review of the physical relationships involved, these two kinds of allowance essentially amount to the same thing and may be regarded as equivalents.) Preferably, to facilitate making this sort of allowance or correction, the determining step includes the substep of warming the printhead without ink ejection—while concurrently monitoring the printhead temperature.

I further prefer, in performing the overall method with this preferable feature included, that:

the heating substep (the substep that is used in actual printhead operation to eject inkdrops) includes directing electrical energy pulses to a firing resistor at pulse widths wide enough to fire ink from the pen; and the warming substep (the substep that is used only to develop a correction for thermal mass of the printhead, with no ink ejection) includes directing electrical energy pulses to the same firing resistor at pulse widths narrower than required to fire ink from the pen.

A related (or alternative) preferable condition is that the heating substep include directing electrical energy pulses to firing resistors at a frequency low enough to fire ink from all desired jet modules of the pen. In this situation by contrast the warming substep preferably includes directing electrical energy pulses to the same firing resistors at a frequency too high to fire ink from the same group of modules.

(These pulse-width and frequency conditions or techniques introduced in the preceding paragraphs may be used together.)

In addition, again with reference to the basic method of this first aspect of the invention, I prefer to include, before performing the volume-ascertaining sequence, finding the calibration relationship. This calibration-finding step preferably includes weighing the pen twice to determine a volume of ink ejected during the calibration-ascertaining step.

Still with reference to the basic method, I prefer that the determining step include the substep of, during the operating step, obtaining a measure of the rate at which the pen temperature changes. This measure-obtaining substep preferably includes automatically fitting a curve to data representing successive temperatures of the printhead; and using the slope of the curve as the measure of said rate. As will be seen, when data acquisition is judiciously controlled it is adequate that such a curve be a straight line, and use of a straight line simplifies the process.

I further prefer that the measure-obtaining substep include monitoring the pen temperature by sensing the resistance of a resistor associated with the pen; and using changes in the sensed resistance to find the measure of pen-temperature change rate.

As will be noted throughout this discussion, I prefer to express my invention in terms of operating an entire printhead, and making observations that relate to the overall thermal characteristics of the entire printhead, rather than in terms of operating or observations of the individual jet modules. The reason for this preference is that, as mentioned earlier, the effects of any small number of individual jet modules would be far more difficult, or more time consuming or expensive, to monitor meaningfully.

In preferred embodiments of a second of its main facets or aspects, the invention is a method of determining volume of ink ejected from a thermal-inkjet pen. The method includes the step of determining the amount of cooling produced by ejection and replacement of the ejected volume; and this determining step in turn includes the substeps of:

warming the pen by directing electrical energy pulses to firing resistors at pulse widths narrower than needed to fire ink from the pen, firing the pen to eject ink in a selected operating mode, by directing electrical energy pulses to the same firing resistors at pulse widths wide enough to fire ink from the pen, and monitoring the pen temperature, by sensing the resistance of a resistor associated with the pen, to obtain a measure of the rate at which the pen temperature changes.

The method according to this second facet or aspect of the invention also includes correlating the determined amount of cooling with ink volume according to a known calibration relationship, to ascertain the magnitude of the volume of ink ejected.

The foregoing may be a definition or description of the second facet of the invention in its most general or broad form. Even in this form, however, this facet of the invention can be seen to be useful to the related technology.

In particular, this method is quickly and readily performed by an automatic printing machine before printing, or between printing intervals—but simply modifying the pulse widths used in its normal printing operation, while maintaining an amount of pen heating that is equal or closely related to the amount which occurs during that normal printing. Once the magnitude of ejected ink volume is ascertained, that information can be used for any beneficial purpose for which ejected ink volume or imminent ink exhaustion, or both, are of interest.

It may be noted that the "warming" substep of this facet or aspect of the invention, and indeed the "warming" operation as mentioned throughout this document, has two distinct purposes. One purpose as already noted is to enable gathering of information about the thermal mass or thermal "capacitance" of the jet module structure; the other purpose is to elevate the printhead temperature in preparation for the "firing" substep.

Hence the procedure as just described can be followed either with or without actually gathering information about thermal mass. I prefer, however, to include that information-gathering function.

In preferred embodiments of a third main aspect or facet, the invention is a method of controlling volume of ink ejected from a thermal-inkjet pen. This method includes the step of establishing volume of ink ejected from a thermal-inkjet pen; this establishing step in turn includes the substeps of:

determining the amount of cooling produced by ejection and replacement of the ejected volume, and correlating the determined amount of cooling with ink volume according to a known calibration relationship, to ascertain the magnitude of the volume of ink ejected.

The method according to this third aspect or facet also includes the step of applying the ascertained magnitude to set subsequently ejected ink volume to a different value. This third facet of the invention is related to certain preferred forms of the facets introduced above, and has related advantages.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
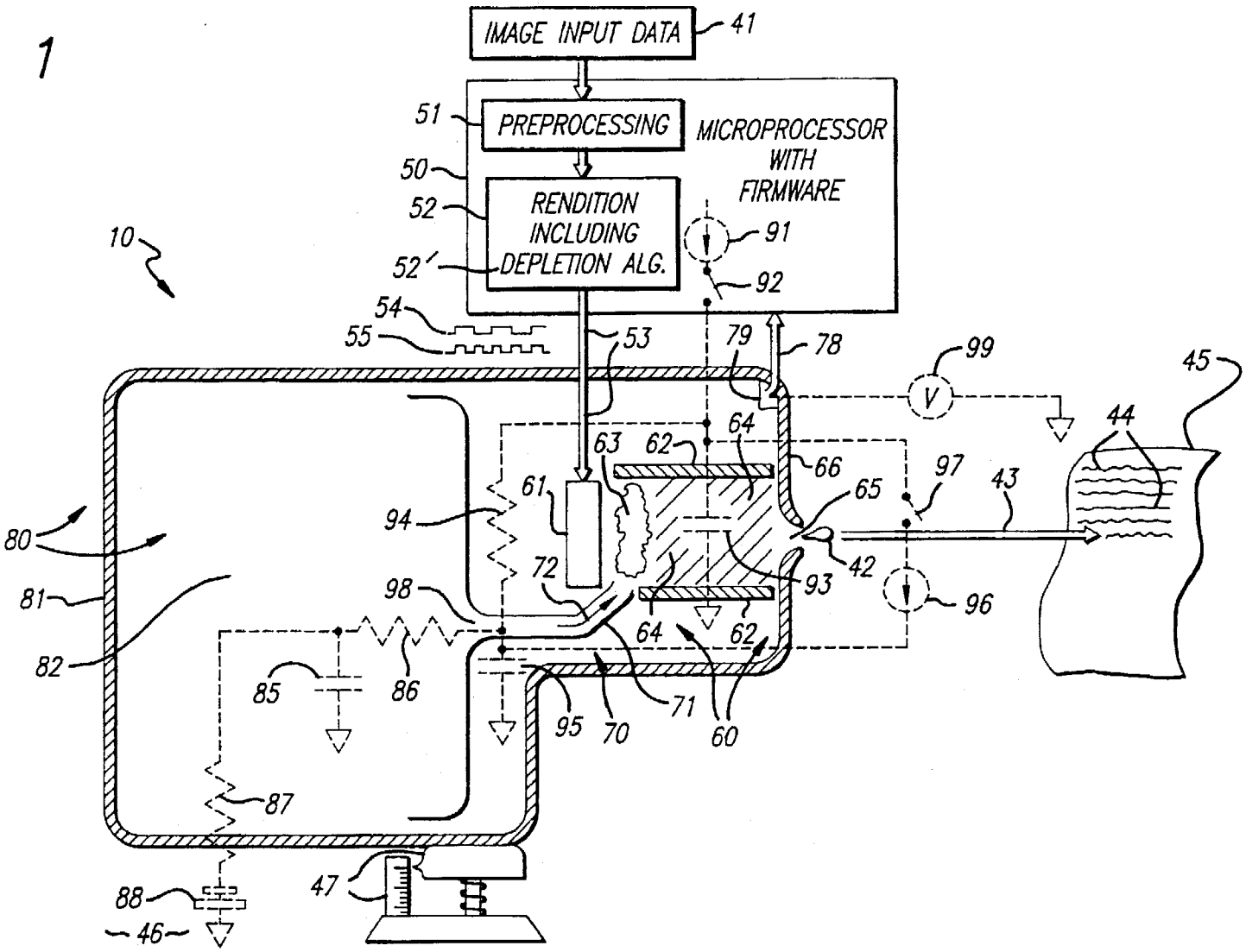
FIG. 1 is a highly schematic representation of a thermal-inkjet printing machine, including a thermal-inkjet pen with a representative jet module, and incorporating preferred embodiments of the invention—and also showing, drawn superimposed upon the pen structure, a representation of an electrical analogue of thermal processes in the pen.

As FIG. 1 indicates, each representative jet module 60 in a thermal-inkjet printer is part of an electro-mechanical system 50–82 that receives input digital image data 41 and responds by marking 42–44 on a sheet 45 of printing medium. The jet module 60 is also, however, part of a thermal system 91–99, 85–88 that directs heat to the printhead, stores some of that heat, and drains some of it, in various ways that depend on just what the printer is doing.

Parts 51, 52 of the electromechanical system massage the input data to perform necessary translations between the specification 41 of a desired image and the detailed language 53 which effectuates the workings of the printer mechanism. These functions, or portions 52 of them, are sometimes called "rendition".

It is known in the art to incorporate into rendition 52 somewhat incidental procedures for controlling the overall inking 42–44 of the printing medium 45—usually for the purpose of avoiding inking that is excessive. Such procedures, the "depletion algorithms" 52' mentioned earlier, are designed to edit out ink spots from the pixel-array pattern 44 to be created on the printing medium 45, but to do so in some inconspicuous way that interferes as little as possible with the desired appearance 41 of the image 44.

The methods of the present invention, which in large part are directed to inking control, can be dovetailed with the depletion-algorithm 52' stage, to control that stage in such a way as to help manage the inking of the printer. In the process the methods of the invention also help manage the thermal system of which the jet modules 60 are a part.

As mentioned earlier, this way of using the invention for controlling overinking is now preferred, but inking-volume information derived through the present invention can be applied or used in ways other than through the depletion algorithms 52'.

The present invention exploits the operation of the jet modules 60 within the pen 10 as parts of a thermal system, to ascertain what amount of ink 42 is being ejected. As shown in FIG. 1, each jet module 60 includes a heating element 61, which for purposes of the thermal system acts as a heat source.

Accordingly the heating element 61 for analytical purposes may be analogized to an input connection from a current source in an electrical system. This analogy is suggested in the drawing by a representation of a current source 91, drawn in dashed lines.

The connection from this current source is drawn as passing through a switch 92, also drawn in dashed lines. This switch 92, in the electrical analogy, represents the capability of the system to selectively provide or not provide heat to the jet modules 60 at any given moment.

The heating element 61, however, also itself has thermal mass. Immediately adjacent to the heater 61 are other thermal components which also have thermal mass: barrier cell walls 62, a propulsion bubble 63 when one is present within the cell 62, liquid ink 64 within the cell, and an orifice or nozzle 65 in an associated portion 66 of an orifice plate.

All these thermal components 61–66 are considered in this document, for analytical purposes of my invention, to be lumped together as a single thermal mass of the jet module 60, which—once again—is usefully analogized to a capacitance in an electrical system. This analogy is suggested in the drawing, particularly for the aggregation of all the jet modules, 60, by a representation of a capacitor 93, also drawn in dashed lines.

Communicating with the jet-module 60 structure and ink is an extended standpipe 71 that directs ink 72 from a pen-reservoir ink supply 82, within the pen body 81, into the barrier cell 62. This extended standpipe 71 and ink 72 within it also have thermal mass—which on average is much less intimately associated thermally with the mass of the jet module 60 than are the materials 61–66 of that module with each other, but much more closely associated with the module 60 than are the ink 82 in the reservoir and the pen body 81 enclosing or defining the reservoir.

The standpipe 71 and ink 72 together I accordingly consider for analytical purposes as an intermediate composite mass 70, also analogized to a capacitance in an electrical system. This analogy too is suggested in the drawing by a representation of another capacitor 95, also drawn in dashed lines.

Similarly the leakage route for thermal drain from the jet-module mass 60 to the intermediate standpipe/ink mass 70 may be analogized to resistance in an electrical system, as suggested in the drawing by a dashed-line representation of a resistor 94.

Further the pen body 81 and ink 82 which it contains form another, relatively remote composite mass 80, whose function as a thermal mass is symbolized in FIG. 1, for purposes of the electrical analogy, by a third capacitor 85 drawn in dashed lines. A leakage route for thermal drain from the intermediate mass 70 to the remote mass 80 of the pen body 81 and pen-reservoir ink 82 may be analogized to resistance in an electrical system, as suggested in FIG. 1 by a dashed-line representation of a resistor 86 interconnecting the second and third capacitors 95, 85.

Within the thermal system 91–99, 85–88, two values of thermal capacitance and resistance 93, 94 are the operative parameters employed in the preferred modes of practicing the method of my invention—to help isolate the cooling due to ink ejection. Those two operative parameters are (1) the thermal mass 60/93 of the jet modules and (2) its leakage path 94 to the intermediate mass 70/95—the composite mass of the standpipe and the ink en route.

Further, however, the system includes thermal drain paths from the remote mass 80 to ambient, or thermal "ground" 46, as suggested by still another thermal resistance 87; this thermal resistances too is drawn in dashed lines. I prefer to conceptualize the leakage route to thermal ground 46 as passing through a thermal "battery" 88 to maintain ambient temperature (as in FIG. 7) at the bottom of the last-illustrated thermal resistance 87.

The thermal mass 85 of, and drain paths 86, 87 to and from, the pen reservoir and body are far more slower-acting than the previously discussed thermal elements 93, 94 more closely associated with the jet module 60. In fact they are so much slower that, once the system is in very general terms up to temperature (on a scale of minutes, or at least large fractions of a minute), the thermal mass 85 and drain paths 86, 87 associated with the reservoir ink 82 and body 81 may not only be lumped together 80 but effectively disregarded—that is, treated as associated with ambient 88/46. (The only caveat to this statement is that, as mentioned earlier, these slower-acting elements may be useful or important in determining the temperature of the intermediate structure 70.)

This simplification yields satisfactory results because the phenomena that are closely connected with ejected ink volume and that are useful for measurement purposes operate on a scale of, for example, just a very few seconds. Thus they are so much faster that the heating or cooling of the pen reservoir ink 82 and body 81 represents no more than extremely slow drifts in measurement background.

There are other reasons for satisfactory results with this simplification. For one, my method requires only a rough or first-order allowance for passive mechanical heat drain. Furthermore, as mentioned later in this document in regard to assumptions about temperature equality, an approximate cancellation of some systematic errors may be expected as between those measurements taken in the field and those taken in laboratory calibration efforts.

Now referring again to FIG. 1, finally the conveying away of heat by ejected inkdrops 42, and replacement of the corresponding ink volume by a replenishing ink flow 72 from the reservoir 82 via the standpipe 71 and propulsion bubble 64—when the pen is actually firing drops 42—may also be analogized to resistive loss or more accurately to a "current drain". Thus the drawing also includes in dashed lines a current drain 96 in parallel with the passive mechanical drain resistance 94—and in series with the current drain 96 a switch 97 to represent the alternative, taught by the present invention, of operating the rest of the thermal system without firing inkdrops 42.

To suggest the association of this heat removal with the firing of inkdrops, the drain 96 and switch 97 are placed on the drawing close to the representations of the inkdrop 42 and jet 43. To also connote, however, the direct role of the replenishment ink 72 in actually cooling the jet modules 60, the current drain 96 has been drawn as returned to the top 98 of the thermal "capacitance" 95 of the intermediate mass 70. That return point 98 represents an important temperature reference point for analytical purposes according to my invention.

The invention contemplates warming 211, 213 (FIG. 2, section 2) the jet modules 60 (FIG. 1) for a selected time interval—that is to say, for each module 60, operating its thermal "heat source" 91 through the "switch" 92 to charge its thermal "capacitor" 93, but without firing the module 60 (i. e., with the "switch" 97 open). The object of this warming is to enable acquisition 210, 214 and storage of data related to the aggregate jet-module thermal mass or "capacitance" 93, or equivalently data concerning the heat flow into and out from that thermal capacitance.

For this purpose, warming power pulses 55 are directed to the heating elements 61 of the jet modules 60 via the same actual electrical connections 53 as used for firing the jet modules 60 to eject inkdrops 42. These pulse trains 55 may be at the same voltage and power as the printing machine uses when producing inkdrops 42—but, to prevent the jet modules 60 from ejecting ink at this stage of the procedure, the pulses 55 used are typically only about 0.8 microsecond wide, narrower than those 54 used to eject ink from the jet modules 60.

To compensate for the narrowness of the pulses, the pulse frequency is made proportionately higher. (By way of explanation, the term "warming" is used here only to help in distinguishing this step of the procedure from the analogous step, denominated "heating", which uses substantially the same overall power but produces ink ejection.)

During warming 213, static mechanical heat drain 212/94 from the jet modules to the intermediate mass naturally takes place too—and in addition some heat flows (not illustrated in FIG. 2) into or out from the thermal mass or capacitance. While these phenomena occur, the apparatus automatically monitors 214 the printhead temperature ("voltage"), preferably by following 99 the resistance of the built-in sensing resistor 79, storing data at intervals closely spaced in time, such as preferably fifty milliseconds; these stored data provide information about the aggregate thermal mass 60/93 of the jet modules—but as will be understood the separation of this information from the effects of the static mechanical heat drain 212/94 requires acquisition of other data as well.

Next the system somewhat increases the pulse width and reduces the pulse frequency to provide 231, 233 the normal power input 54 used to fire the pen to eject ink-drops—that is to say, to hold the power substantially unchanged while changing pulse width and frequency. As before some of this input heat flows into or out from the thermal mass or capacitance 93, and some flows 232 through the drain path 94 to the intermediate thermal mass 70 (and thence to the reservoir ink 85 and pen body 81 etc.)—and the system automatically monitors 99/234 the printhead temperature.

In addition, however, now ink 42 is ejected, represented in the electrical analogue by closure of a switch 97, and this ink 42 carries away 235/96 some heat. Furthermore, volumetric replacement 236/72 of that ink from the normal supply path has the direct cooling effect of bringing cooler ink 72 into the jet modules 60 (which is to say, in the aggregate, the printhead) from the intermediate mass 70.

The result is to acquire 234 information related to the cooling produced by those two newly introduced phenomena 235/96, 236/72. Additional steps will be required to separate this information from the already-acquired information about the thermal mass 93 of the head, and also from the static mechanical drain 94 as mentioned above.

Next the system stops 240 the heat input (disconnects 92 the thermal "current source" 91) and monitors 263 the rate of temperature decrease (discharge through the thermal "resistance" 94 etc.) to learn the magnitude of the thermal drain 262/232/212 path (the size of the drain "resistor") 94 to the intermediate mass 70/95. When heat input is discontinued 240 and the printhead is not firing inkdrops 42, the only significantly operative "components" in the thermal circuit are the jet-module thermal capacitance 93 and the drain-resistance path 94 to the intermediate mass 70/95.

Here I say "significantly operative" because as noted earlier the drain paths 86, 87 to the pen body and reservoir ink 81–82/85 and from those thermal components to ambient 88/46, and the thermal mass 85 of the body 81 and ink 82, remain present and operative. For calculation purposes they can be disregarded because their response is so slow in comparison with the effects 93, 94, 96 which are related more intimately to the jet module 60.

(In a system other than my most highly preferred embodiment of the invention, this thermal mass 85 of the body 81 and ink 82—and the associated drain paths 86, 87—could be used to find the temperature $\underline{T}_{98}$ of the intermediate mass 70. (In the dashed-line part of the drawing, representing the electrical analogue, this is the temperature for the thermal "circuit" node 98, at the top of the intermediate-mass thermal "capacitance" 95.)

As will be seen, this temperature is needed to develop a value for the temperature differential $\Delta\underline{T}$ of the jet modules 60 relative to the intermediate thermal mass 70. From the thermal masses and drain paths 85–87 it might be possible to obtain a relatively more accurate value of $\underline{T}_{98}$ by extrapolation back to the starting point of the passive decay. For the present system I prefer to deduce $\underline{T}_{98}$ from the measured before-and-after weights of the pen 10 and contained ink 82.)

The module-60-to-intermediate-mass-70 drain path 94 is relatively more consistent—as between different jet modules 60 and as between different pens 10—than the path 96, 97 corresponding to heat carried off in the ejected ink. In purest principle, therefore, reasonable results could be obtained by measuring in advance an average value for the drain path 94, over a fairly large number of jet modules 60 and pens 10—and then assuming that that average value was applicable to all jet modules 60 in all pens 10.

The drain path 94 to the intermediate mass 70, however, also dominates the thermal loss path 96, 97 corresponding to heat carried away by ejected inkdrops 42. For this reason it is preferable to actually perform 210 this measurement, automatically, for each aggregation of jet modules 60—or in other words for each pen 10.

Figure 2A:
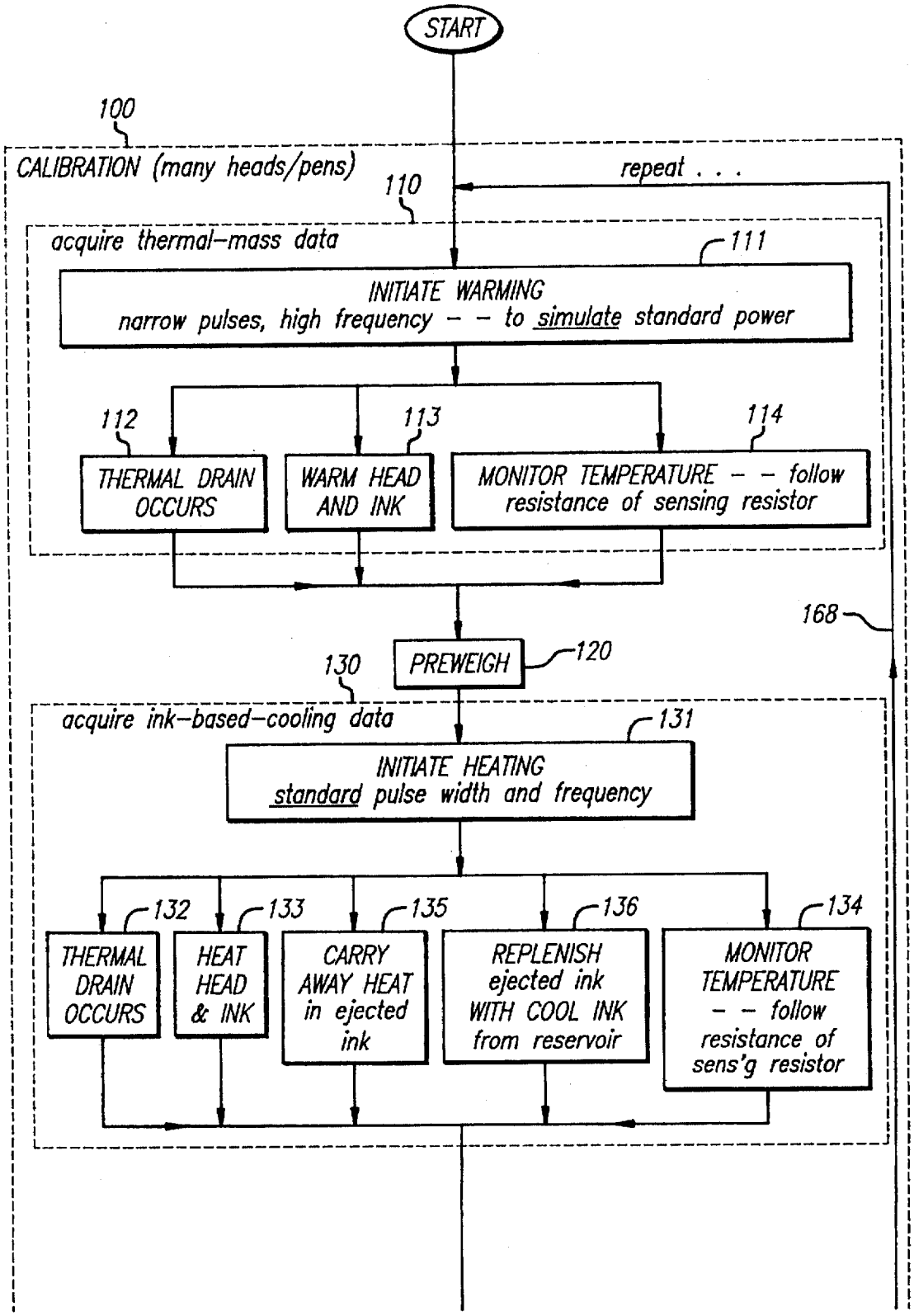
FIG. 2 is a logic flow diagram showing the procedures of the invention as implemented partially through firmware programmed into a thermal-inkjet printing machine, partially through manually initiated weight determinations, and partially through conventional calculation.
Figure 2B:
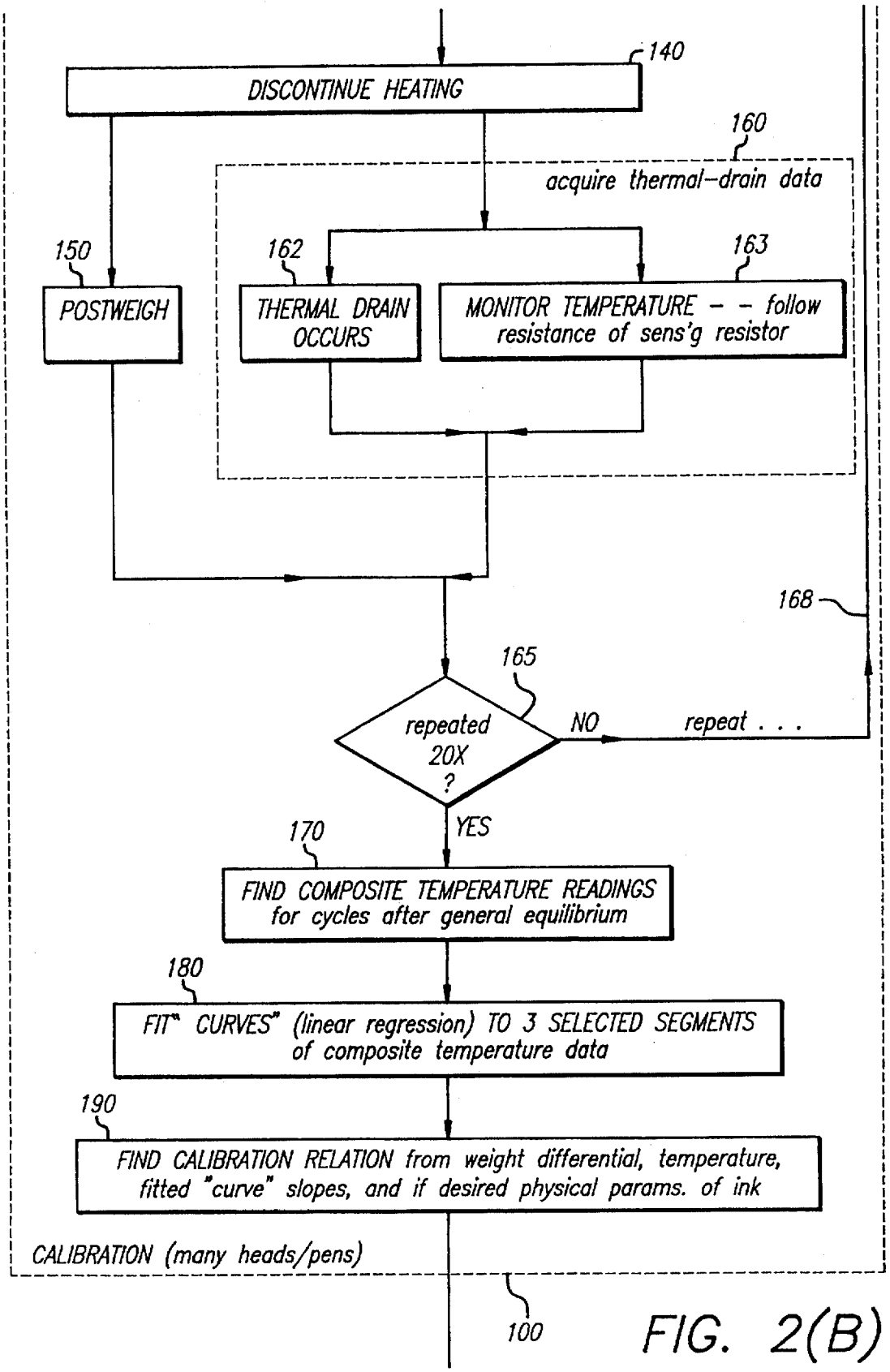
Figure 2D:
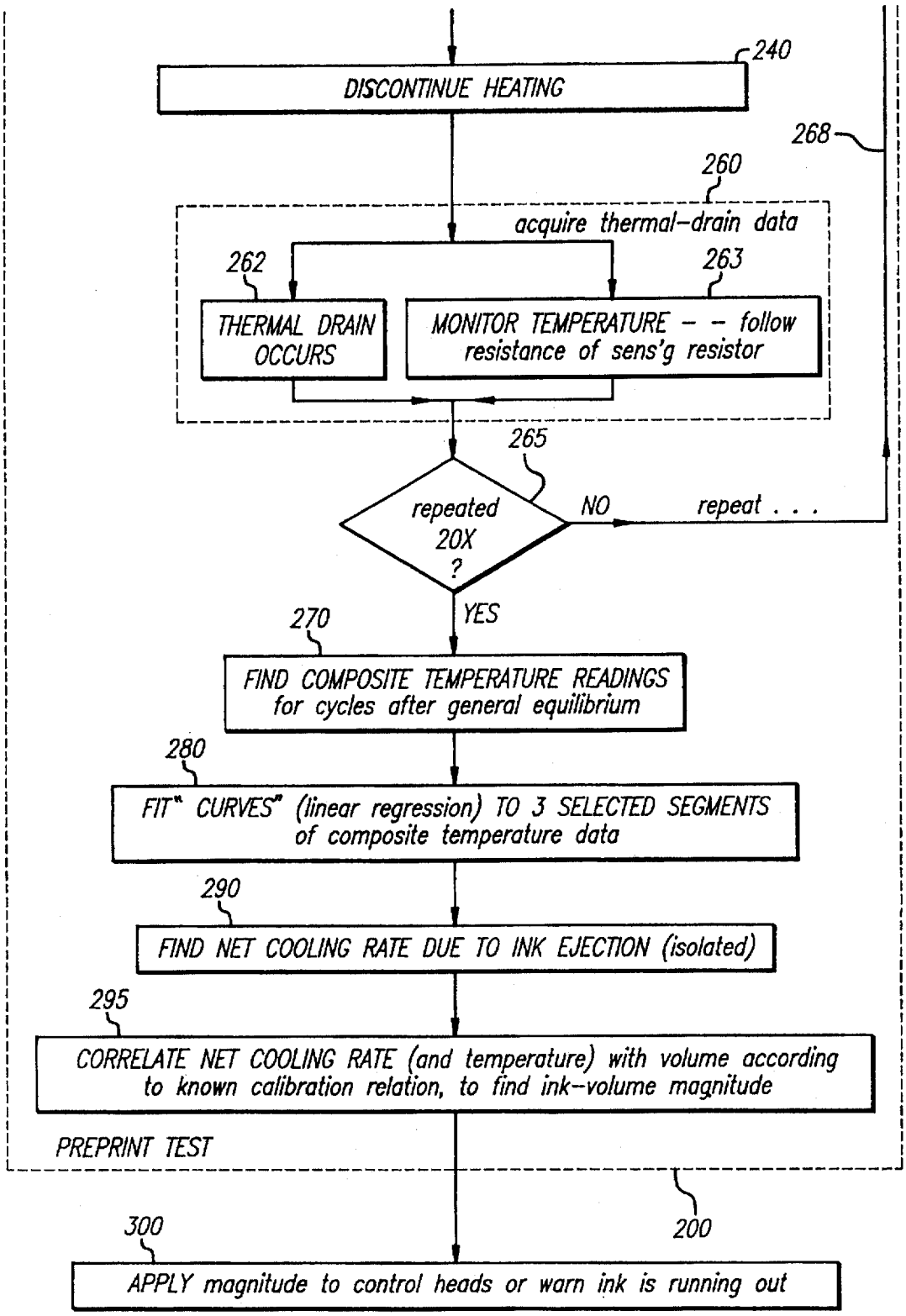
Figure 3:
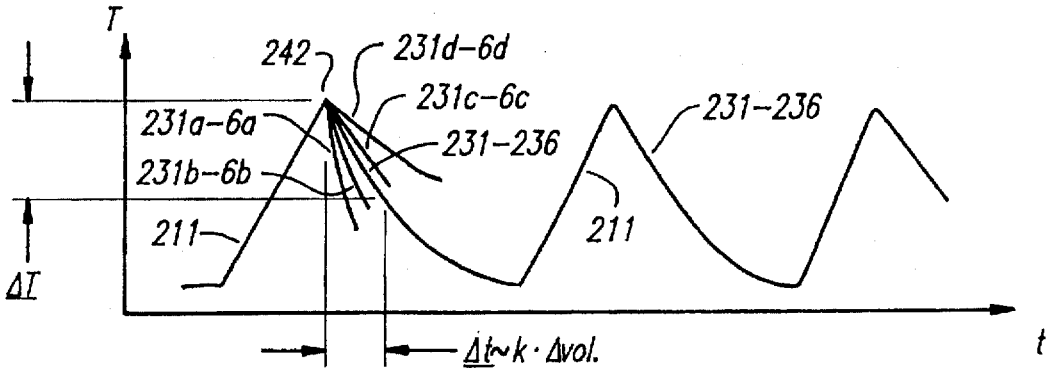
FIG. 3 is a conceptual graph of temperature vs. time in a simplified series of prewarming/ink-ejecting cycles, the ink-ejecting phase of each cycle being performed in a generally conventional ink-ejecting mode—including heating of the printhead by jet-module-firing pulses and cooling by the resulting conveyance of ink from and to the printhead—for measurement of the net cooling rate during ink ejection.

If the warming 210 and heating/firing 230—but not the drain determination 260—are repeated several times, the resulting temperature-vs.-time behavior may be generally as shown in the simplified conceptual graphs of FIG. 3. The slope 231–236 (corresponding to the like-numbered portions of FIG. 2) of the downward portion of the graph in each cycle is related to the drop volume. In other words, other steeper slopes 231*a*–236*a*, 231*b*–236*b* or shallower slopes 231*c*–236*c*, 231*d*–236*d* result from ejection of, respectively, greater or lesser drop volumes.

The general effect is shown dramatically by comparing two graphs of actual temperature-vs.-time data which I made early in my work on the present invention. One graph, FIG. 4, was made using a normally operating pen; and the other, FIG. 5, was made using the same pen with a third of the jet modules taped over so that they could not eject ink. (The stepwise appearance of the graphs results from automated digitization of the data.)

Figure 4:
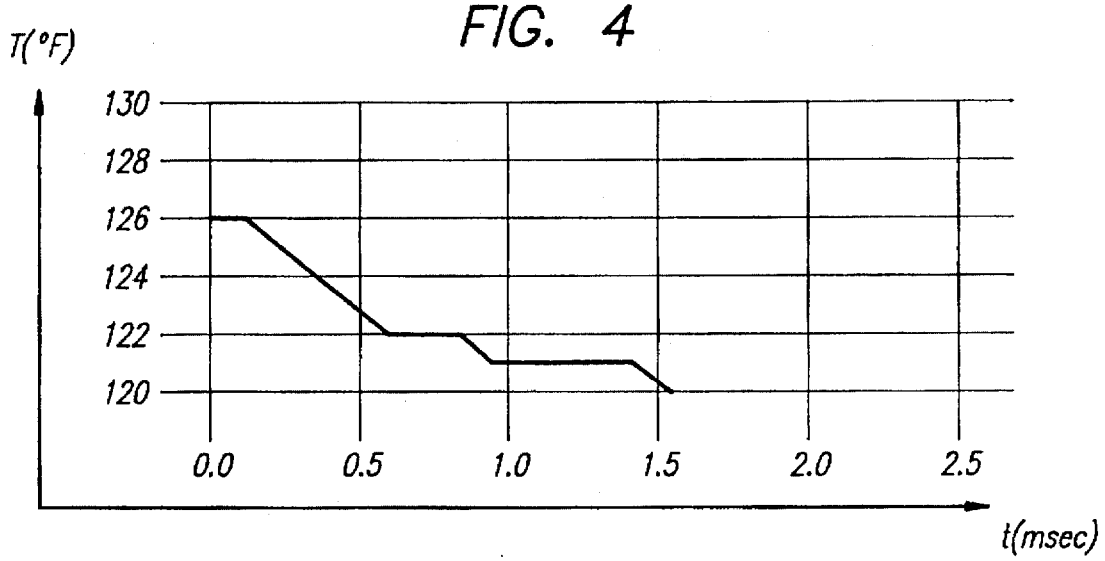
FIG. 4 is an automatically produced graph of actual temperature-change data found through operating a thermal-inkjet pen in the same conventional mode as described above for FIG. 3.
Figure 5:
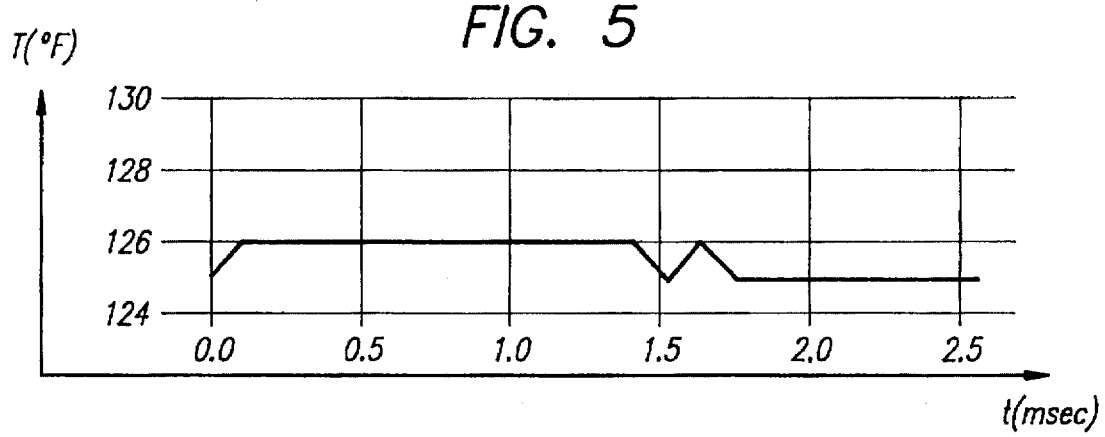
FIG. 5 is a like graph of actual temperature-change data found through operating the same pen in the same general way, except that one-third of the jet modules had been disabled to prevent their participating in cooling.

As will shortly be seen, however, while FIGS. 3 through 5 convey a main thrust of my invention and may illustrate a procedure adequate for finding ink-ejection volume in some printers, a preferred way of practicing my invention is to incorporate the thermal-drain measurements discussed in connection with FIG. 2.

For purposes of an automated test, in principle to determine cooling rate it is possible to either measure the differential $\Delta T$ through which the temperature falls in a preselected time interval $\Delta t$, or to measure the time $\Delta t$ required for the temperature to fall through a preselected differential $\Delta T$; in either event the measured differential is related, through the absolute temperature, to the ejected volume.

Of these two approaches, the first may be somewhat more readily amenable to simple automation. For best results, however, I prefer to use neither of these methods but rather to acquire data for a considerably larger number of time points—and in fact to iterate 268 (FIG. 2) such acquisition so that the overall data are reliable—and then to form 270 a composite for at least two (optimally many) of the iterations, and to fit 280 straight lines to certain segments of the composite data by linear regression. Iteration may be eliminated as will be discussed later.

I then use 290 the slopes of these fitted lines, as representative of the slopes of interest, in calculating a measure of the net cooling rate due to ink ejection—isolated algebraically from the effects of thermal mass and static drain. Finally the resulting measure can be rendered 295 in terms of ink-volume magnitude, and this overall result applied 300 for a beneficial purpose such as, for example, controlling the jet modules (either directly or by use of a depletion algorithm or other procedure), or warning of imminent ink exhaustion.

As to the processes 290, 295 for determining a measure of inkdrop-cooling in isolation, each inkdrop carries away an amount of energy proportional to its volume and absolute temperature—or, considering only the net energy carried to the intermediate mass 70 (standpipe 71 and ink 72 in it), proportional to its temperature differential above the intermediate mass 70. Thus knowing the cooling rate, the temperatures, and the calibration relation permits deduction 290, 295 of the drop volume being ejected.

More specifically, adjusting the observed cooling rate for the known thermal drain 96 through the pen body 81 and for the known heat input 91, and dividing the adjusted cooling rate by the temperature above that of the intermediate mass—and by the numerical rate of drop 42 ejection—yields 260 the volume of each drop 42.

This value includes effects of tolerances in ink properties, heating resistance, jet-module dimensions (sizes and relative placements of the resistor, cell walls and orifice), and back-pressure at the standpipe 71. Therefore this value is the most highly variable one of the three, and is the one of direct, real interest. This value, for reasons mentioned earlier, is not readily measured individually for each jet module—but an average for all modules is preferably measured for each pen by each printing machine.

In preparation for doing so, however, the entire three-stage measurement must be carried out 100 (FIG. 2, section 1) in advance—preferably for many pens—but also incorporating determination 120, 150 of the amount of ink actually fired, to develop a reliable calibration relationship. It is that relationship which then can be used 290, 295 in the field to find the rate of ink volume ejection from the observed net cooling rate.

For this purpose, the amount of ink actually fired in this third stage 130 of the calibration sequences 100 is readily determined by weighing the pen before 120 and after 150 ejecting a known number of drops whose cooling effect has been observed. I emphasize that for best results this weighing should be performed before and after the identical drop-ejection sequence 130 used to find the cooling effect.

To facilitate this concurrent or essentially simultaneous performance of both parts of the calibration, the geometry 47, 81 of the test apparatus used for the cooling sequence is ideally or in purest principle such that the two weighings 120, 150 can be performed without moving the pen from its operating position—as may be suggested by FIG. 1, which represents the pen 10 as resting on a scale 47. In my work toward development of a calibration, however, I have found it satisfactory to weigh the pen in a separate location different from its operating position.

(In my efforts to refine the invention I found that conducting the weighing before and after a separate ink-ejection procedure—in other words, under different conditions from the cooling-sequence measurements—led to troublesome erratic or "noisy" results.)

This is important because the weight differential to be determined is rather small. At the same time, however, the calibration geometry should be reasonably close to the environment of the pen in normal use, so that thermal relationships during calibration are adequately representative of those during field operation of production printers.

Theoretically the amount of ink actually ejected may also be ascertained by weighing the target toward which the ink is ejected, rather than the pen; such an approach might be considered preferable in that the overall weight of the target may be made much smaller than that of the pen. Because a substantial and variable amount of ink is subject to evaporation both before and after reaching the target, however, I prefer to weigh the pen.

To validate satisfactory measurement precision I repeated 168 the warming/firing/drain cycle 110–160 (also suggested in FIG. 3) about twenty times in succession. After eliminating a large source of noise through concurrence of these measurements with weighing procedures, as outlined above, I succeeded in reducing the standard deviation in measured size of an individual drop to approximately one-half picoliter.

To obtain such good precision I also found it useful to average the rate of temperature change within each stage of the temperature-vs.-time sequence respectively—namely, temperature fall 160, 260 with no input power, temperature rise 110, 210 with input power, and temperature fall 130, 230 at a lower rate due to firing the pen.

Figure 6:
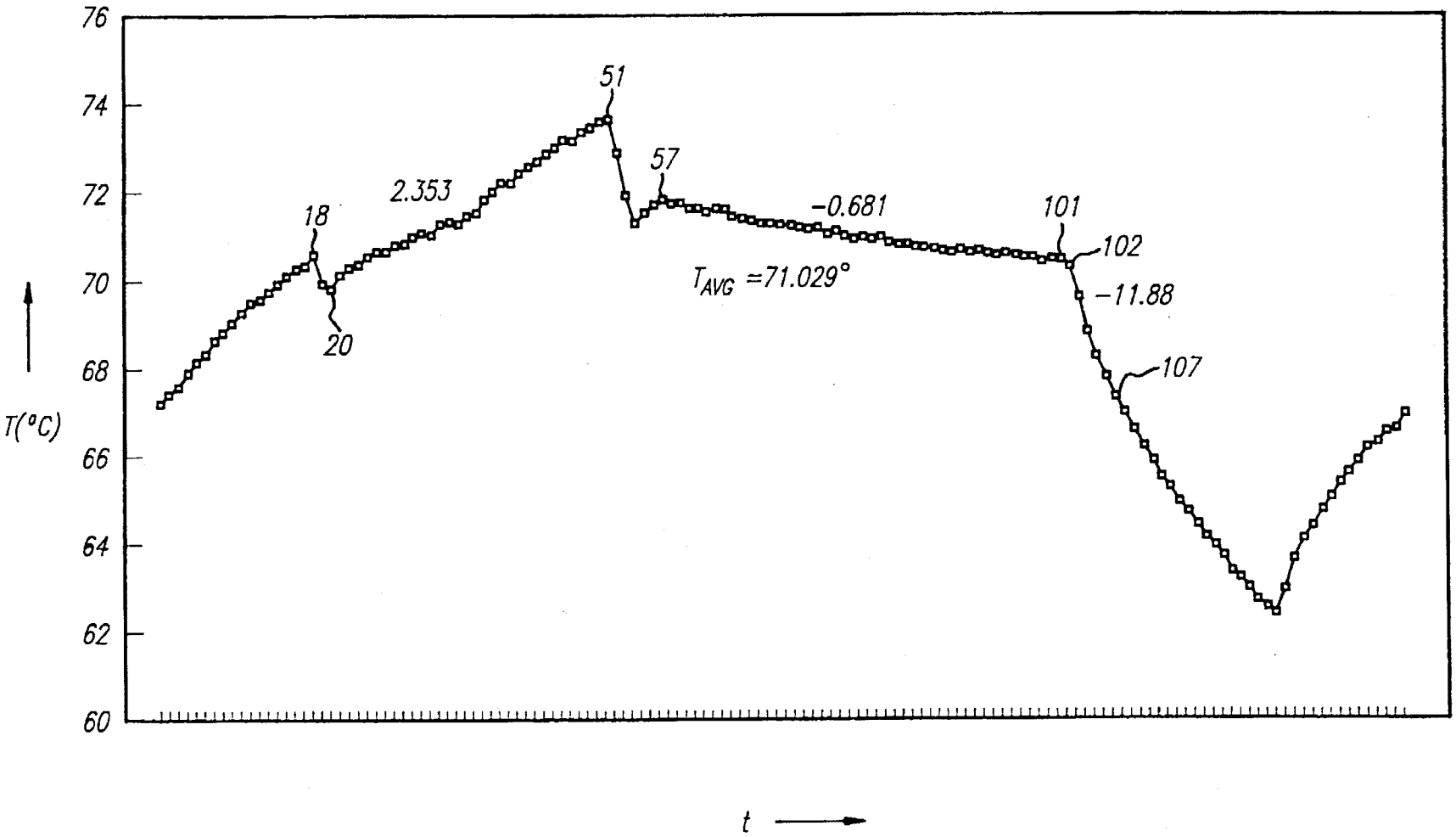
FIG. 6 is a composite graph of actual temperature-vs.-time data acquired according to my invention and using a more complex warming/ink-ejecting/cooling cycle which I have found to be a preferable refinement.

FIG. 6 shows actual data representing a composite of the last eighteen of twenty thermal cycles monitored according to my invention. The dots are spaced relative to the abscissa at fifty-millisecond intervals, and dots of particular significance are numbered.

Values along the ordinate represent temperature in degrees Centigrade. The discontinuities at dots numbered 18 through 20, and at dots 51 through 57, are artifacts due to switching and the like in the electronics. (The dot numbers used here are not to be confused with the reference numerals placed on the other drawings of this document to identify elements of the apparatus and its electrical analogue.)

The segment of the composite graph from dots 102 through 107 represents data acquired during thermal-drain cooling only—in other words, monitoring of the system with no power applied to the jet-module heaters and with no ink being ejected. For definiteness this condition will be called "case A" and exhibits a downward (negative) slope of about 12° C./sec, as marked on the figure. This part of FIG. 6 corresponds directly to the "case A" operational mode diagrammed at the left side of FIG. 7, and to the acquisition 160, 260 of thermal-drain data in FIG. 2.

Next the segment from dots 20 through 51—"case B"—represents data during warming of the jet modules with short power pulses at an operating frequency higher than normal, so as to simulate normal heating but without ink ejection. This warming—represented with respect to power input and absence of ink output as "case B" at the center of FIG. 7, and corresponding to the acquisition 110, 210 of thermal-mass data in FIG. 2—is superimposed upon the thermal-drain cooling of case A, and results in a net upward slope of nearly 2½° C./sec as indicated.

Figure 7:
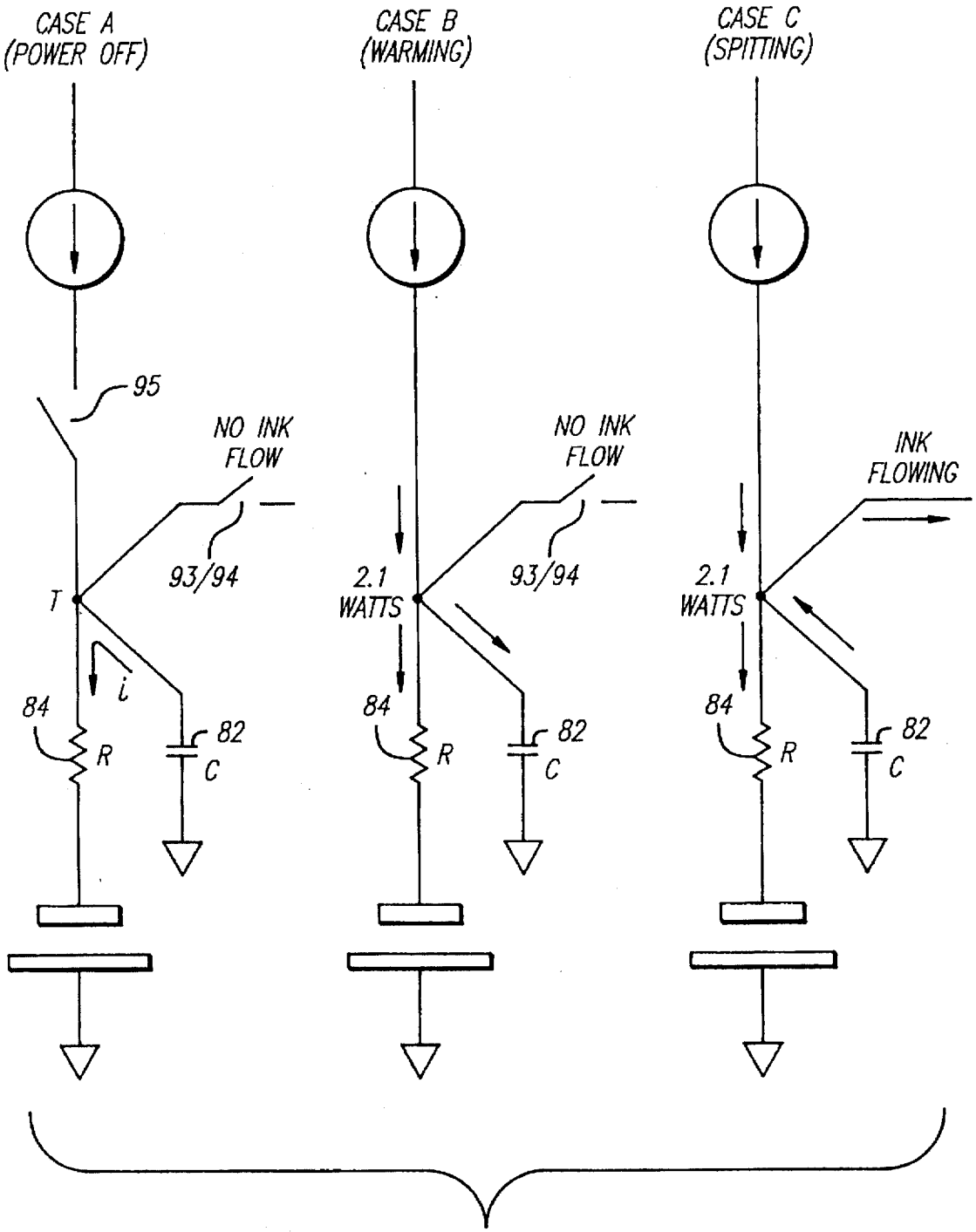
FIG. 7 is a group of three diagrams showing a simplified thermal model, in terms of an electricity-flow analogue as mentioned above, and here particularly including heat-input and -output paths for three operational modes that are employed as parts of my invention.

The segment from dots 57 through 101 is "case C"; it corresponds to the like-marked right-hand portion of FIG. 7, and also to the acquisition 130, 230 of ink-based-cooling data in FIG. 2. These data were acquired during substantially normal operation—in other words, with heating at ordinary pulse frequency and width, so as to eject ink at a rate within the normal operating range. In this mode of operation the ink ejection accordingly is superimposed upon the heating effects of case B as well as the thermal-drain cooling of case A.

Here the slope is downward but slight, and has magnitude just below 0.7° C./sec. Using the values indicated on the diagram, the three slopes are roughly $s_a$=−11.9, $s_b$=+2.4, and $s_c$=−0.68; these values may be taken as typical for a current production printhead in the Hewlett Packard line, and possibly are also representative of present conventional thermal-inkjet printheads generally.

For case C as marked the average temperature for the entire segment (dots 57 through 101) is just over 71° C., which may be taken as approximately fifty degrees above typical ambient or roughly forty above the intermediate mass. The average temperatures for the other two segments (cases A and B) are both roughly equal to this value.

As will be evident the temperature for case A (the steeper decline at the right) is about two degrees lower. This difference is held to such a small value by using only the first few data points of the steep decline; also it may be borne in mind that a like systematic error is incurred in the data acquisition for calibration, and probably these two errors mutually cancel in at least the first order.

In practice for best operation of my invention I have found it most natural to start with case B, then proceed to case C and finally to case A. This cycle, however, I have preferred to repeat twenty times—and then to discard data from the first two cycles, as the system then is not yet well equilibrated—to obtain a very stable and representative composite as shown in FIG. 6; hence it becomes somewhat academic whether the overall twenty-cycle observation actually starts with case B or case C.

My purpose in using twenty iterations of the measurement cycle has been primarily to validate accuracy of the measurement process. The twenty iterations require nearly two minutes, which in the field would be an unduly long time for taking a printer out of service.

Under field conditions the measurement process should be performed at startup, or from time to time during protracted operation, or both. As will be appreciated, an operator would likely find such long delay objectionable.

Therefore, although my invention is usable in the form described, the invention contemplates refining the analytical process so that adequate volume indications are extracted from, say, just one or two cycles. Additional modeling or data gathering may be needed to obtain the relationship between measurements in the first few cycles and the more-fully-equilibrated measurements described in this document and used to-date.

During the warming segment, which is case B, preferably each heating pulse is 0.8 μsec long; these pulses are at 6 kHz, to each jet module. The average power into the jet module is 2.1 W, and this warming continues for 3.2 seconds.

During the ink-ejecting (or more familiarly "spitting") part of the cycle, case C, the duration of each heating pulse is 2.4 μsec and the frequency of the pulses is 2 kHz, to each jet module. The power continues at 2.1 W for 2.4 seconds.

The passive thermal-drain part of the cycle, case A, has no associated heating pulses and lasts for one second.

I shall now set forth more explicitly how the results of these measurements can be used to find the average volume of each ink drop. That volume, in cubic centimeters per drop, is given first by $v=F/\nu$, where F represents the volumetric flow rate of ink, cubic centimeters per second, and the Greek letter $\nu$ represents the firing frequency, i. e., number of drops per second.

Next F can be related to the amount of heat O transferred in time $\Delta t$ by:

$$O=\rho c F \Delta \underline{T} \cdot \Delta t,$$

where:

$\rho$ is the density (g/cc) of the ink, c is the specific heat (cal/g °C.) of the ink, and $\Delta \underline{T}$ is the temperature differential (°C.) above the intermediate mass 70.

Hence the volume v of each drop is $F/\nu=O/(\nu\rho c\Delta \underline{T}\cdot t)$. Because we know the amount of heat injected into the system in terms of watts, it is convenient to relate the rate of heat transfer in terms of calories $O/\Delta t$ to power P expressed in watts, flowing out of the system with a stream of inkdrops, by $$4.18 \cdot O/\Delta t(\text{cal/sec})=P_{out}(W),$$

so the average drop volume is $$v(cc)=P_{out}/(4.18\nu\rho c\Delta T).$$

Temperature $\Delta \underline{T}$ (°C.) above that of the intermediate mass is known (roughly), as are c, $\rho$ for the ink and the firing rate $\nu$.

Therefore it remains only to show how a value for the power $P_{out}$ carried away in the ink stream can be automatically approximated through simple monitoring of temperature changes under controlled conditions, as suggested above. For this purpose I revert to the electrical analogy introduced earlier.

Referring to FIG. 7, and in particular case A illustrated at left in that diagram, under the circumstances represented here no power is being injected into the system and no ink is flowing out. Hence the heat flow i is only that flowing out of the system from the thermal capacitance C through the composite thermal resistance R to ambient or intermediate-mass temperature.

That heat flow $i_R$ obeys the conventional relation, essentially the definition of capacitance C—

$$i_{R(a)}/C=(\Delta V/\Delta t)_a,$$

where the subscript "a" indicates that this relation is being applied to case A of FIG. 7. For simplicity's sake the slope $(\Delta V/\Delta t)_a$ for this case A will be denominated $s_a$, so that the heat flow $i_{R(a)}$ out through the thermal resistance R can be written $$i_R=s_a \cdot C.$$

Next proceeding to case B represented at the center of FIG. 7, still no ink flows but heat $i_{in}$ is being pumped into the system by applying power to the electrical heater which actuates the printhead. For practical systems of interest in my work, I have used $i_{in}$=2.1 W, which is nominally equal to the average power level used in normal operation of a print head.

As shown in the diagram, heat flow $i_{c(b)}$ is now into the thermal capacitance C, rather than out as in case A. Because the average temperature now is roughly the same as in case A, however, I take the outward heat flow $i_R$ through the thermal resistance to ambient as equal to that occurring in case A. This assumption allows a summary of the heat-flow relations thus:

$$(i_{in}-i_R)/C=(\Delta V/\Delta t)_b\equiv s_b,$$

where for this case B an abbreviated notation for the slope $s_b\equiv(\Delta V/\Delta t)_b$ is introduced to simplify later expressions, as with the notation given above for case A.

Now combining the two expressions involving the heat flow $i_R$ through the thermal resistance, and involving also the thermal capacitance C, found from cases A and B, it is possible to eliminate the value $i_R$ and so find the thermal capacitance:

$$(i_{in}-i_R)/C=s_b$$

$$i_{in}-i_R=C\cdot s_b$$

$$i_{in}-C\cdot s_a=C\cdot s_b$$

$$C=i_{in}/(s_a+s_b).$$

Now reintroducing the expression for heat flow through the thermal resistance, $$i_R=C\cdot s_a=i_{in}\cdot s_a/(s_a+s_b),$$

in which all the parameters appearing on the right side can be found through the automatic monitoring processes.

What is actually sought, however, as will be recalled is a value more closely related to the outward flow of ink, namely the heat flowing out with the ink, in case C—at the right in FIG. 7. Once again the starting points are fundamental expressions—the relation for heat flow out of the thermal capacitance, and the balance between heat flows in the three other legs of the system, in this third case C:

$$i_{c(e)}=C(\Delta V/\Delta t)_c\equiv C\cdot s_c,$$

$$i_{out}=i_{in}+i_{c(e)}-i_R$$

and the heat flow $i_R$ through the thermal resistance is again taken as roughly equal to those in cases A and B, since the average temperature is roughly the same. Now the thermal capacitance C is already known from the previous derivations, while the slope $s_c$ for this case, like the first two, is subject to observation through monitoring. Consequently the heat flow out with the ink in this case can be expressed as—

$$i_{out}=i_{in}+i_{c(e)}-i_R$$

$$i_{out}=i_{in}+C\cdot s_c-i_R$$

$$i_{out}=i_{in}+i_{in}\cdot s_c/(s_a+s_b)-i_{in}\cdot s_a/(s_a+s_b).$$

Now collecting terms, simplifying, and inserting the results into the initial expression for drop volume:

$$i_{out}=i_{in}(1+s_c/(s_a+s_b)-s_a/(s_a+s_b))$$

$$i_{out}=i_{in}\cdot(s_a+s_bs_c-s_a)/(s_a+s_b)$$

$$i_{out}=i_{in}\cdot(s_b+s_c)/(s_a+s_b)$$

$$\underline{v}(cc)=\frac{\underline{i_{in}}(\underline{s_b}+\underline{s_c})}{4.18\nu\rho\underline{c}\Delta\underline{T}(\underline{s_a}+\underline{s_b})}.$$

Using values noted in FIG. 6 for slopes $s_a$=−11.9, $s_b$=2.4, $s_c$=−0.68 and temperature ΔT=71−56=15° C. (roughly) relative to the intermediate mass, setting the input power $i_{in}$=2.1 W at ν=300 kHz (representing 2 kHz to each of an assumed one hundred fifty jet modules), and further using representative ink values ρ=1.03 g/cc, c=1 cal/g °C., yields a typical inkjet drop size: 24 pL.

Naturally as a practical matter the value of inkdrop volume v need not be in cubic centimeters or any other conventional units, so long as determined values are compared with compatible threshold values for overinking, or as mentioned earlier for early warning of ink exhaustion—or in any event with compatible values obtained as calibration. Accordingly if desired some parameters can be regarded as constants and lumped into determination of a normalized volume v'—as for instance $$\underline{v}'(\text{arbits})=\frac{\underline{s_b}+\underline{s_c}}{\Delta\underline{T}(\underline{s_a}+\underline{s_b})}.$$

Using the same values listed above for slope and temperature relative to ambient yields v'=0.012 (the arbitrary units here amounting to reciprocal °C.).

As mentioned earlier, the measurement results in a production printing machine can be applied 300 (FIG. 2) to the depletion-algorithm 52' (FIG. 1) part of the machine firmware to control the overall inking. To make optimum use of this system, the pen and its energization are designed so that the minimum-ejected-drop case, in view of all tolerances, is always adequate to avoid inadequate-inking image defects—and the tests introduced by the present invention are applied 300 to control depletion algorithms 52' to avoid excessive-inking image defects.

Various operating factors tend to interfere with obtaining reliable data for the purposes described above, and should be either controlled or taken into account. One of these factors is the temperature of the intermediate mass 70 of the pen 10.

This can be estimated, and its significance assessed, if desirable by first discontinuing power application and then checking the thermal-sensing resistor 79 readout 99 after a quarter-minute to a half-minute—when the printhead temperature has begun a relatively very slow decline toward ambient. Such a slow decline indicates that the printhead is nearly equilibrated with the usually much greater combined thermal mass of the reservoir and its ink contents.

Another such factor is the starting temperature, which should be carefully controlled. Still another is the thermal "resistance" (temperature differential per unit applied power) between the sensing resistor 79 and the ink 82—which must depend on manufacturing uniformity but ordinarily is substantially more consistent than the overall inkdrop volume.

Further still, the thermal-sensing resistor 79 itself is subject to manufacturing tolerance; this can affect the starting temperature for the cooling-rate measurements, and thereby indirectly all the rate values. A second-order interferant may be the amount of energy and power going into the heating resistor 61 to eject drops 42.

Other factors that have not been recognized may also come into play. Accordingly those skilled in the technology of this invention will readily recognize that application of the invention to each new pen-and-printer system calls for an intelligent and informed evaluation of the particulars of that system.

It will be understood that the foregoing disclosure is intended to be merely exemplary, and not to limit the scope of the invention—which is to be determined by reference to the appended claims.

What is claimed is:

1. A method of operating a thermal-inkjet printing machine that has a printhead for ejecting ink by operation of an electrical heater to form an ink vapor bubble whose expansion behind an inkdrop propels the inkdrop from the printhead toward an adjacent printing medium; said method comprising the steps of:

performing a sequence of operations to ascertain a volume of ejected ink which includes the steps of:

operating the printhead to eject a volume of ink, said operating step comprising the substeps of (1) heating the ink and the printhead, (2) carrying away heat, in the ejected volume of ink, from the printhead, and (3) conveying a volume of cooler ink to the printhead, from an ink supply, to replace the ejected volume of ink;

determining an amount of cooling of the printhead produced by the carrying-away and conveying substeps; and correlating the determined amount of cooling with ejected ink volume according to a predetermined calibration relationship, to ascertain a magnitude of the volume of ink ejected; and then applying said ascertained magnitude to control actuation of the printhead to eject ink for marking on a printing medium.

2. The method of claim 1, wherein:

said applying step comprises application of said ascertained magnitude to control the electrical heater and thereby the volume of ink ejected for marking on the print medium.

3. The method of claim 2, wherein:

said applying step comprises application of said ascertained magnitude to control a depletion algorithm which controls the volume of ink ejected for marking on the print medium.

4. The method of claim 1, wherein said applying step further comprises:

determining whether said ascertained magnitude corresponds to imminent ink-supply exhaustion; and triggering a low-ink-supply operating mode when said ascertained magnitude corresponds to imminent ink-supply exhaustion.

5. The method of claim 4, wherein:

said low-ink-supply operating mode comprises warning an operator of imminent ink-supply exhaustion.

6. The method of claim 4:

further comprising, concurrently with said printhead actuation for marking on a printing medium, provision of relative motion between the printing medium and a marking axis of the pen; and wherein said low-ink-supply operating mode comprises inhibiting the relative motion and the marking.

7. The method of claim 4, particularly for use in a printing machine that has at least two thermal-inkjet printheads, and wherein:

said low-ink-supply operating mode comprises taking out of service one of said printheads for which ink-supply exhaustion is imminent, and putting into service another of said printheads.

8. The method of claim 1, for use with a printhead that is part of a thermal-inkjet pen, and wherein:

said determining step comprises making an allowance for thermal leakage from the printhead to a body of the pen.

9. The method of claim 8, wherein:

said determining step comprises monitoring printhead temperature decline while no heat is applied to the printhead and no ink is ejected from the printhead.

10. The method of claim 1, wherein:

said determining step comprises making an allowance for thermal mass of the printhead, or for heat flow into or out from the thermal mass.

11. The method of claim 10, wherein:

said determining step comprises the substep of warming the printhead without ink ejection; and concurrently monitoring the printhead temperature.

12. The method of claim 11, wherein:

the heating substep comprises directing electrical energy pulses to a firing resistor at pulse widths wide enough to fire ink from the printhead; and the warming substep comprises directing electrical energy pulses to said firing resistor at pulse widths narrower than required to fire ink from the printhead.

13. The method of claim 11, wherein:

the heating substep comprises directing electrical energy pulses to a firing resistor at a frequency low enough to fire ink from the printhead; and the warming substep comprises directing electrical energy pulses to the same firing resistor at a frequency too high to fire ink from the pen.

14. The method of claim 1, further comprising:

before performing the volume-ascertaining sequence, finding the calibration relationship.

15. The method of claim 14, wherein:

the calibration-finding step comprises weighing the pen twice to determine a volume of ink ejected during the calibration-finding step.

16. The method of claim 1, wherein said determining step comprises the substep of:

during the operating step, obtaining a measure of a rate at which the pen temperature changes.

17. The method of claim 16, wherein the measure-obtaining substep comprises:

automatically fitting a curve to data representing successive temperatures of the printhead; and using a slope of the curve as the measure of said rate.

18. The method of claim 16, wherein the measure-obtaining substep comprises:

monitoring the printhead temperature by sensing a resistance of a resistor associated with the printhead; and determining said measure of the printhead-temperature changing rate in accordance with a predetermined relationship between the resistance of the resistor and the printhead-temperature changes.

19. A method of determining volume of ink ejected from a thermal-inkjet pen, by operation of an electrical heater to form an ink vapor bubble whose expansion behind an inkdrop propels the inkdrop from a nozzle toward an adjacent printing medium; said pen having a reservoir and passageways for replacement of ejected ink, and said method comprising the steps of:

determining an amount of cooling produced by ejection and replacement of the ejected volume, said determining step including the substeps of:

preheating the pen by directing electrical energy pulses to a firing resistor at pulse widths narrower than needed to fire ink from the pen, firing the pen to eject ink in a selected operating mode, by directing electrical energy pulses to said firing resistor at pulse widths wide enough to fire ink from the pen, and monitoring the pen temperature, by sensing the resistance of a resistor associated with the pen, to obtain a measure of the rate at which the pen temperature changes; and correlating the determined amount of cooling with ink volume according to a predetermined calibration relationship, to ascertain the magnitude of the volume of ink ejected.

20. A method of controlling volume of ink ejected from a thermal-inkjet pen, by operation of an electrical heater to form an ink vapor bubble whose expansion behind an inkdrop propels the inkdrop from a nozzle toward an adjacent printing medium; said pen having a reservoir and passageways for replacement of ejected ink, and said method comprising the steps of:

establishing volume of ink ejected from a thermal-inkjet pen; said establishing step including the substeps of:

determining an amount of cooling produced by ejection and replacement of the ejected volume, and correlating the determined amount of cooling with ink volume according to a predetermined calibration relationship, to ascertain a magnitude of the volume of ink ejected; and applying the ascertained magnitude to set subsequently ejected volume of ink to a different value.

* * * * *